US006019500A

United States Patent [19]

Hasegawa et al.

[11] Patent Number: 6,019,500

[45] **Date of Patent: *Feb. 1, 2000**

[54] METHOD AND APPARATUS FOR MEASURING CUMULATIVE TIME

[75] Inventors: Nobuo Hasegawa; Ryoichi Tojo, both of Chiba, Japan

[73] Assignee: Sony Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/675,409

[22] Filed: Jul. 2, 1996

[30] Foreign Application Priority Data

Jul. 3, 1995 [JP] Japan ..... P07-166725

[51] Int. Cl.[7] ..... G04B 17/20

[52] U.S. Cl. ..... 368/202; 368/107

[58] Field of Search ..... 368/10, 202, 9, 368/6, 7, 8, 107

[56] References Cited

U.S. PATENT DOCUMENTS 4,197,582 4/1980 Johnston et al. ..... 364/483
5,164,923 11/1992 Avis ..... 368/4

*Primary Examiner*—Bernard Roskoski
*Attorney, Agent, or Firm*—Hill & Simpson

[57] ABSTRACT

An apparatus for measuring cumulative time of operation time of an electrical equipment is comprised of a CPU having a nonvolatile memory and a RAM. This apparatus executes the following steps: (1) reading cumulative time data Ts of the nonvolatile memory and presetting it to a timer counter of the RAM when a measurement command is turned on wherein Ts is a value represented by Ts=(A minutes×n+A/2 minutes) when n is a positive integer; (2) measuring ON time on the timer counter in which Ts is preset; (3) checking as to whether the ON time becomes integer time A minutes; (4) When the ON time becomes integer times A minutes, the sum of the ON time and A/2 minutes is read in the nonvolatile memory as Ts. Therefore, the accumulated error of the cumulative time is decreased.

12 Claims, 2 Drawing Sheets

METHOD AND APPARATUS FOR MEASURING CUMULATIVE TIME

BACKGROUND OF THE INVENTION

1. Field of the Invention

The present invention relates to an electrical equipment such as a television receiver or video tape recorder, and more particularly to a cumulative time measuring method and apparatus for measuring a total operation time of the equipment and storing it.

2. Description of the Prior Art

Japanese Provisional Publication No. 1-136291 discloses a time monitoring system whose time measurement starts at each turning-on of a main electric source of an electrical equipment and cumulatively updates cumulative time data stored in a nonvolatile memory at proper time intervals on the basis of a time period measured by a digital signal processing system such as a microprocessor or one-chip microcomputer. The cumulative time data recorded in the nonvolatile memory corresponds to a total operation time of the equipment and is available for a maintenance of the equipment. In general, a cumulative time measuring method is arranged such that the cumulative time data is cumulated in the nonvolatile memory by each predetermined time period such as 10 minutes. That is, when the elapsed time from the turning-on of the measuring command becomes integer times 10 minutes, the cumulative time data is increased by 10 minutes.

However, such a conventional method where the cumulative time data is cumulated by 10 minutes unit as mentioned above, has a problem that the accumulated error of the cumulative time data becomes very large wherein a concrete numeral such as 10 minutes is not a nature of the problem, and is merely used for facilitating the understanding of the explanation. That is, when 10 minutes has elapsed after the turning-on of the measuring command, 10 minutes is added to the cumulative time data, and when 10 minutes has further elapsed, 10 minutes is again added to the cumulative time data. Accordingly, in case that a time period during which the measuring command is turned on is in a range from 10 minutes within 20 minutes, the increment amount of the cumulative time data is 10 minutes in every cases. Therefore, as to an increment amount for one time due to the change of the measurement command from ON to OFF, there is an error of 9 minutes 59 seconds in maximum, and 5 minutes in average. Since this error is accumulated by each turning-on of the measurement command, if the number of times of the turning-on becomes several thousands or further several ten thousands, the accumulated error becomes extremely large.

SUMMARY OF THE INVENTION

It is an object of the present invention to provide a cumulative time measuring method which is arranged to minimize the accumulated error of the cumulative time without using a means for shortening a time interval for the update of cumulative time data and an additional electrical equipment applying the same.

A first aspect of the present invention resides in a method for measuring cumulative time in a digital signal processing system. The method comprises the steps of starting a measurement of cumulative time when an electric source of an electrical equipment is turned on, updating cumulative time data stored in a nonvolatile memory at a proper time intervals, storing a value represented by (A×n+a) as the cumulative time data Ts in the nonvolatile memory, adding A to the cumulative time data Ts at a time when the measured time from the turning-on of the measurement command becomes (A−a), and repeatingly adding A to the cumulative time data Ts at each increase by A of the measured time; wherein A is a previously determined constant time, a is a previously determined constant time which is generally half the time A, and n is positive integer.

Another aspect of the present invention resides in an apparatus for measuring cumulative time in a digital signal processing system. This apparatus comprises means for starting a measurement of cumulative time when an electric source of an electrical equipment is turned on, means for updating cumulative time data stored in a nonvolatile memory at predetermined time intervals, means for storing a value represented by (A×n+a) as the cumulative time data Ts in the nonvolatile memory, means for adding A to the cumulative time data Ts at a time when the measured time from the turning-on of the measurement command becomes (A−a), and means for repeatingly adding A to the cumulative time data Ts at each increase by A of the measured time; wherein A is a previously determined constant time, a is a previously determined constant time which is generally half the time A, and n is a positive integer.

DETAILED DESCRIPTION OF THE INVENTION

Figure 1:
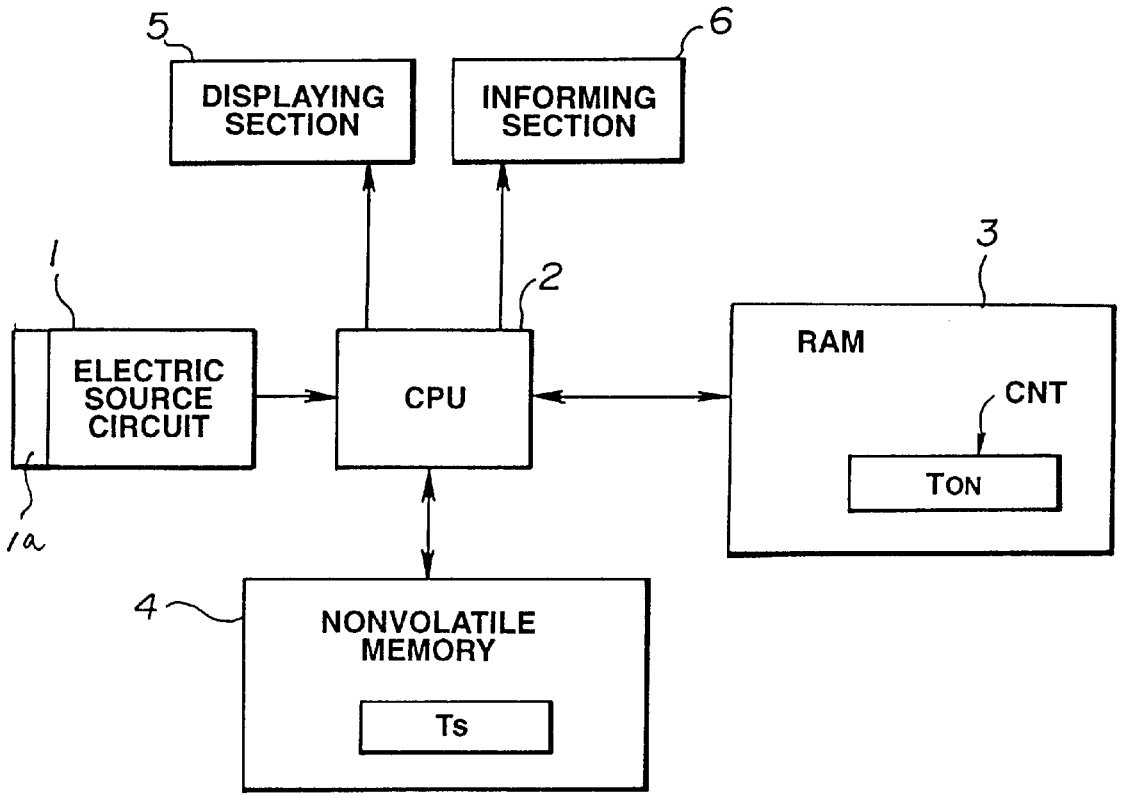
FIG. 1 is a schematic block diagram which shows a digital signal processing system of a first embodiment according to the present invention.

Referring to FIG. 1, there is shown a first embodiment of a method and apparatus for measuring cumulative time according to the present invention.

This method according to the present invention is applied to an electrical equipment such as a television receiver or video tape recorder, and is arranged to execute a time measuring operation in reply to a measurement command which is outputted from an electric source circuit 1 when a main electric source of the applied electrical equipment is turned on or when an electric source of a functional device thereof is turned on. This apparatus comprises a central processing unit (CPU) 2 which is electrically connected with the electric source circuit 1, a RAM (random access memory) 3, a nonvolatile memory 4 such as EEPROM, a displaying section 5 such as a LED (light emitting diode) display, and an informing section 6 such as an alarm. The electric source circuit 1 is connected with an electric source 1*a* and outputs a measurement command to the CPU 2 when the electric source 1*a* is in a turned-on condition. Upon receipt of the measurement command, the CPU 2 starts counting ON time of the electrical equipment by using a timer counter CNT of the RAM 3. The timer counter CNT of the RAM 3 is cleared by each turning-on of the electric source la and executes increment thereof as far as the electric source la is kept in the turned-on condition. Further, the CPU 2 updates cumulative time data Ts by each predetermined increment of the ON time. The cumulative time date Ts represents a total operation time of the equipment and is stored in the nonvolatile memory 4. The display section 5 receives data indicative of a detailed value or round numeral value of the cumulative time data Ts from the nonvolatile memory 4 through the CPU 2, and displays the received value. The informing section 6 receives an informing signal when the cumulative time data Ts becomes greater than a predetermined value, and then generates an information output such as an alarm sound.

Figure 2:
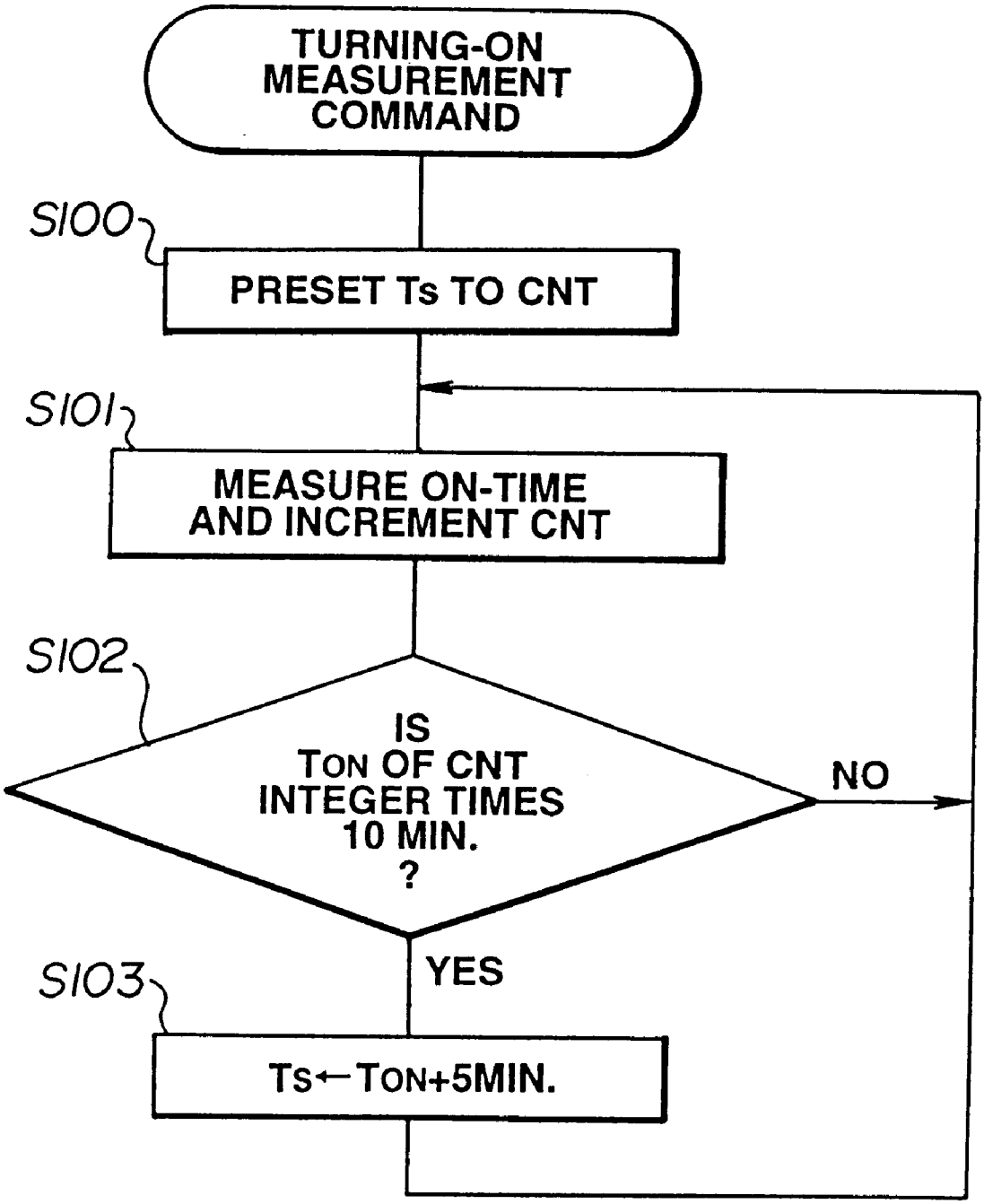
FIG. 2 is a flowchart which shows a processing procedure of the cumulative time measuring method of the first embodiment.

A flowchart of FIG. 2 shows a processing procedure of the cumulative time measurement executed in the first embodiment according to the present invention. The process shown in this flowchart starts when the electric source la is turned on and is always executed during when the electric source 1*a* is in the turned-on condition, that is, during when the measurement command is sent from the electric source circuit 1 to the CPU 1.

At a step S100, the CPU 2 reads the cumulative time data Ts of the nonvolatile memory 4 and presets the cumulative time data Ts in the timer counter CNT of the RAM 3. The cumulative time data Ts of the nonvolatile memory 4 is a value represented by Ts=(10 minutes×n+5 minutes) wherein n is a positive integer. Although the cumulative time data Ts is stored or represented by minute unit, the timer counter CNT is arranged to have an area for 1 second of 10 minutes as a minimum unit of the time measurement.

Next, at a step S101, the CPU 2 measures the ON time Ton by means of the timer counter CNT and operates the timer counter CNT to increment the ON time Ton according to the increment of the turned-on time of the electric source 1*a*.

At a step S102, the CPU 2 checks as to whether the ON time Ton is integer times 10 minutes or not. When the decision at the step S102 is "NO", the routine returns to the step S101 and repeats the steps S101 and S102 until the decision at the step 102 becomes "YES". When the decision at the step S102 is "YES", the routine proceeds to a step S103. Since the cumulative time data Ts preset in the timer counter CNT is Ts=(10 minutes×n+5 minutes), the time data Ton of the timer counter CNT becomes integer times 10 minutes at a time when 5 minutes elapsed from a turning-on of the measurement command.

At the step S103, the CPU 2 writes a value obtained by adding 5 minutes to Ton into the nonvolatile memory 4 as Ts. Following this, the routine returns to the step S101 and repeats the steps S101, S102 and S103. That is, the cumulative time data Ts of the nonvolatile memory 4 is incremented by 10 minutes and updated from (10 minutes×n+5 minutes) to {10 minutes×(n+1)+5 minutes}.

From this time, Ton becomes integer times 10 minutes by each 10 minutes increment of the measured time. Accordingly, the cumulative time data Ts of the nonvolatile memory 4 is cumulatively updated by 10 minutes such that {10 minutes×(n+2)+5 minutes}→{10 minutes×(n+3)+5 minutes}→{10 minutes×(n+4)+5 minutes}. The routine of FIG. 2 is promptly stopped when the electric source circuit 1 stops outputting the measurement command.

Since the cumulative time data Ts becomes a value represented by (10 minutes×n+5 minutes), the error of the increased amount of the cumulative time data Ts with respect to the actual ON time is ±5 minutes in maximum and generally 0 in average even if the value of minute unit of the actual ON time of the measuring command is deviated from 0 minutes to 9 minutes. Therefore, the accumulated error becomes far small as compared with a conventional one.

Although in the above-mentioned embodiment the cumulative time data Ts is preset in the timer counter CNT at the step S100, it will be understood that this step may be replaced by presetting 5 minutes in the timer counter CNT if a value (Ton+Ts) is calculated and is rewritten in the nonvolatile memory as a new Ts at the step S103. As clear from the processing principle, it is possible to execute equal processing even if the preset of 5 minutes is canceled.

Next, a second embodiment of the cumulative time measuring method and apparatus according to the present invention will be discussed. The construction of the second embodiment is the same as that of the first embodiment except that the preset of the timer counter CNT is not executed.

As similar to the first embodiment, when the measurement command is turned on, the time measurement is started at the timer counter CNT. Further, when the ON time Ton of the timer counter CNT becomes 10 minutes, 15 minutes is added to the cumulative time data Ts of the nonvolatile memory 4. Thereafter, by each 10 minutes increment of the measuring time Ton of the time counter CNT, 10 minutes is added to the cumulative time data Ts. This method ensures a functional merit generally similar to that of the above embodiment.

In the case that an EEPROM, which has a limit in writing times as a nonvolatile memory 4, is used as a memory to be updated, it is preferable to utilize a method disclosed in Japanese Patent Provisional Publication No. 1-277397. According to this conventional method, a plurality of writing portions of the minimum unit data of the cumulative time data Ts are prepared in the EEPROM, and are in turn used as a memory while being changed in turn. This increases the maximum value of the recordable cumulative time.

With the thus arranged method and apparatus according to the present invention, even if a value of a recorded minimum unit of a time that the measuring command is practically turned on is deviated between 0 and A, the error of the increased amount of the cumulative time data Ts with respect to the actual ON time is ±(A/2) in maximum and generally 0 in average. Therefore, the accumulated error is far small as compared with the conventional one.

What is claimed is:

1. A method for measuring cumulative time in a digital signal processing system, the method comprising the steps of:

determining a time constant A representing a cumulative time updating increment;

determining a correction factor time constant a representing an average error of cumulative time each time an electric source of an electrical piece of equipment is turned on, wherein a is generally one-half of A;

starting a measurement of cumulative time when the electric source of the electrical piece of equipment is turned on;

preparing a plurality of writing portions in an EEPROM, each writing portion equaling a minimum unit time data of cumulative time data $T_s$;

initially adding A to the plurality of writing portions wherein A is added to the cumulative time data $T_s$ previously stored in the plurality of writing portions to make an added value;

storing the added value in the plurality of writing portions as said cumulative time data $T_s$ at a time when the measurement of cumulative time becomes (A−a); and repeatedly adding A to the cumulative time data $T_s$ stored in the plurality of writing portions to make an updated added value and storing the updated added value in the plurality of writing portions as the cumulative time data $T_s$ at each increment A of the measurement of cumulative time after the step of adding A.

2. A method as claimed in claim 1, further comprising a step for displaying and outputting one of a detailed value and a round number of the cumulative time data stored in the nonvolatile memory.

3. A method as claimed in claim 1, further comprising a step for generating an information output when the cumulative time data stored in the nonvolatile memory becomes greater than a predetermined value.

4. A method for measuring cumulative time in a digital signal processing system, the method comprising the steps of:

determining a time constant A representing a cumulative time updating increment;

determining a correction factor time constant a representing an average error of cumulative time each time an electric source of an electrical piece of equipment is turned on, wherein a is generally one-half of A;

starting a measurement of cumulative time when the electric source of the electrical piece of equipment is turned on;

preparing a plurality of writing portions in an EEPROM, each writing portion equaling a minimum unit time data of cumulative time data $T_s$;

initially adding (A+a) to the plurality of writing portions wherein (A+a) is added to the cumulative time data $T_s$ previously stored in the plurality of writing portions to make an added value;

storing the added value in the plurality of writing portions as the cumulative time data $T_s$ at a time when the measurement of cumulative time first reaches A; and repeatedly adding A to the cumulative time data $T_s$ stored in the plurality of writing portions to make an updated added value and storing the updated added value in the plurality of writing portions as the cumulative time data $T_s$ at each increment A of the measurement of cumulative time after the step of adding (A+a).

5. A method as claimed in claim 4, further comprising a step for displaying and outputting one of a detailed value and a round number of the cumulative time data stored in the nonvolatile memory.

6. A method as claimed in claim 4, further comprising a step for generating an information output when the cumulative time data stored in the nonvolatile memory becomes greater than a predetermined value.

7. An apparatus for measuring cumulative time in a digital signal processing system, the apparatus comprising:

determining a time constant A representing a cumulative time updating increment;

determining a correction factor time constant a representing an average error of cumulative time each time an electric source of an electrical piece of equipment is turned on, wherein a is generally one-half of A;

means for starting a measurement of cumulative time when the electric source of the electrical piece of equipment is turned on;

preparing a plurality of writing portions in an EEPROM, each writing portion equaling a minimum unit time data of cumulative time data $T_s$;

means for initially adding A to a plurality of writing portions wherein A is added to a cumulative time data $T_s$ previously stored in a non-volatile memory to make an added value;

means for storing the added value in a plurality of writing portions as the cumulative time data $T_s$ at a time when measurement of cumulative time first becomes (A−a); and means for repeatedly adding A to the cumulative time data $T_s$ stored in the plurality of writing portions to make an updated added value and storing the updated added value in the plurality of writing portions as the cumulative time data $T_s$ at each increment A of the measurement of cumulative time after initially adding A to a cumulative time data Ts.

8. An apparatus as claimed in claim 7, further comprising means for displaying and outputting one of a detailed value and a round number of the cumulative time data stored in the nonvolatile memory.

9. An apparatus as claimed in claim 7, further comprising means for generating an information output when the cumulative time data stored in the nonvolatile memory becomes greater than a predetermined value.

10. An apparatus for measuring cumulative time in a digital signal processing system, the apparatus comprising:

determining a time constant A representing a cumulative time updating increment;

determining a correction factor time constant a representing an average error of cumulative time each time an electric source of an electrical piece of equipment is turned on, wherein a is generally one-half of A;

means for starting a measurement of cumulative time when the electric source of the electrical piece of equipment is turned on;

preparing a plurality of writing portions in an EEPROM, each writing portion equaling a minimum unit time data of cumulative time data $T_s$;

means for initially adding (A+a) to a plurality of writing portions wherein (A+a) is added to a cumulative time data Ts previously stored in the plurality of writing portions to make an added value;

means for storing the added value in the plurality of writing portions as the cumulative time data $T_s$ at a time when the measurement of cumulative time first becomes A; and means for repeatedly adding A to the cumulative time data $T_s$ stored in the plurality of writing portions to make an updated added value and storing the updated added value in the plurality of writing portions as the cumulative time data $T_s$ at each increment A of the measurement of cumulative time after initially adding (A+a) to a cumulative time data Ts.

11. An apparatus as claimed in claim 10, further comprising means for displaying and outputting one of a detailed value and a round number of the cumulative time data stored in the nonvolatile memory.

12. An apparatus as claimed in claim 10, further comprising a step for generating an information output when the cumulative time data stored in the nonvolatile memory becomes greater than a predetermined value.

* * * * *